United States Patent [19]

Zane

[11] Patent Number: 4,986,536

[45] Date of Patent: Jan. 22, 1991

[54] LEG EXERCISER

[76] Inventor: Frank Zane, P.O. Box 2031, Palm Springs, Calif. 92263

[21] Appl. No.: 453,691

[22] Filed: Dec. 20, 1989

[51] Int. Cl.[5] ..... A63B 21/072

[52] U.S. Cl. ..... 272/123; 272/119; 224/266

[58] Field of Search ..... 272/96, 116, 117, 119, 272/123, 143; 224/265, 266

[56] References Cited

U.S. PATENT DOCUMENTS

| | | | |
|---|---|---|---|
| 3,322,425 | 5/1967 | Moore . | |
| 3,370,850 | 2/1968 | Moore | 272/119 |
| 3,679,107 | 7/1972 | Perride | 272/119 X |
| 4,306,715 | 12/1981 | Sutherland | 272/117 |
| 4,605,222 | 8/1986 | Shannon | 272/123 X |
| 4,765,612 | 8/1988 | Henry, Jr. | 272/119 |

FOREIGN PATENT DOCUMENTS

| | | | |
|---|---|---|---|
| 779572 | 4/1935 | France | 272/119 |

OTHER PUBLICATIONS

Advertisement for "Moore's Leg Blaster", in Iron Man Magazine, vol. 44, No. 4, May 1985.

*Primary Examiner*—Robert Bahr
*Attorney, Agent, or Firm*—Mark C. Jacobs

[57] ABSTRACT

A leg trainer device for use in carrying out deep knee bends and standing calf exercises, which trainer may be used in conjunction with a means to enhance balance during periods of use.

The device includes a main body formed from a plurality of frame members, and a pair of spaced shoulder supports which are attached to said main body. Angularly disposed weight holding members are attached to frame members of the main body.

17 Claims, 2 Drawing Sheets

LEG EXERCISER

This invention relates to a weight-lifting exercise device, and particularly to a device which is worn on the shoulders during exercise to allow freedom of the arms for balance especially during those exercises known as barbell squats.

Barbells which consist generally of a straight metal tube supporting selective round weights attached at the end thereof. Different exercises are employed in the use of barbells. One is the so-called squat wherein the barbell is held usually on the shoulders around the neck and body trunk is lowered substantially vertically while the legs are bent at the knees and then back straight again and so on for as many times as conditioning allows.

Another exercise in which barbells are used are deep knee bends, and yet another are the standing calf exercises.

The use of standard barbells for doing squats is not completely satisfactory for various reasons. For one thing the hands are unavailable for balance should such be required. In addition the weights are not positioned in the ideal location.

When one desires to do deep knee bends, the presence of the barbells creates body instability. Calf exercises are also difficult to perform using standard barbells. For these and other reasons, James Moore developed the weight-lifting exercise device disclosed and claimed in U.S. Pat. No. 3,322,425.

Unfortunately Moore's device also has several deficiencies, and there have been few developments in this area since his invention.

Thus it is seen that there has been a need for quite some time for an easy to use barbell weight-lifting device which makes it easy and convenient and safe to perform deep knee bends and standing calf exercises.

It is an object therefore of this invention to provide an improved weight-lifting device for carrying out exercises.

It is another object to provide a new weight-training device for the performance of deep knee bends and standing calf exercises.

Yet another object is to provide a weight-training device that is easy to mount to one's shoulders, and is easy to remove therefrom.

A still further object is to provide a weight-training device upon which weights may be readily added and removed.

These and other objects of the invention will in part be apparent from a reading of the specification when taken in conjunction with the accompanying drawings.

SUMMARY OF THE INVENTION

A weight-training device for carrying out deep knee bends and standing calf exercises among others. It consists of a main body formed from a plurality of frame members, and a pair of spaced shoulder supports attached to said frames. Angular weight holding members are attached to said frame.

DESCRIPTION OF THE PREFERRED EMBODIMENT

Figure 1:
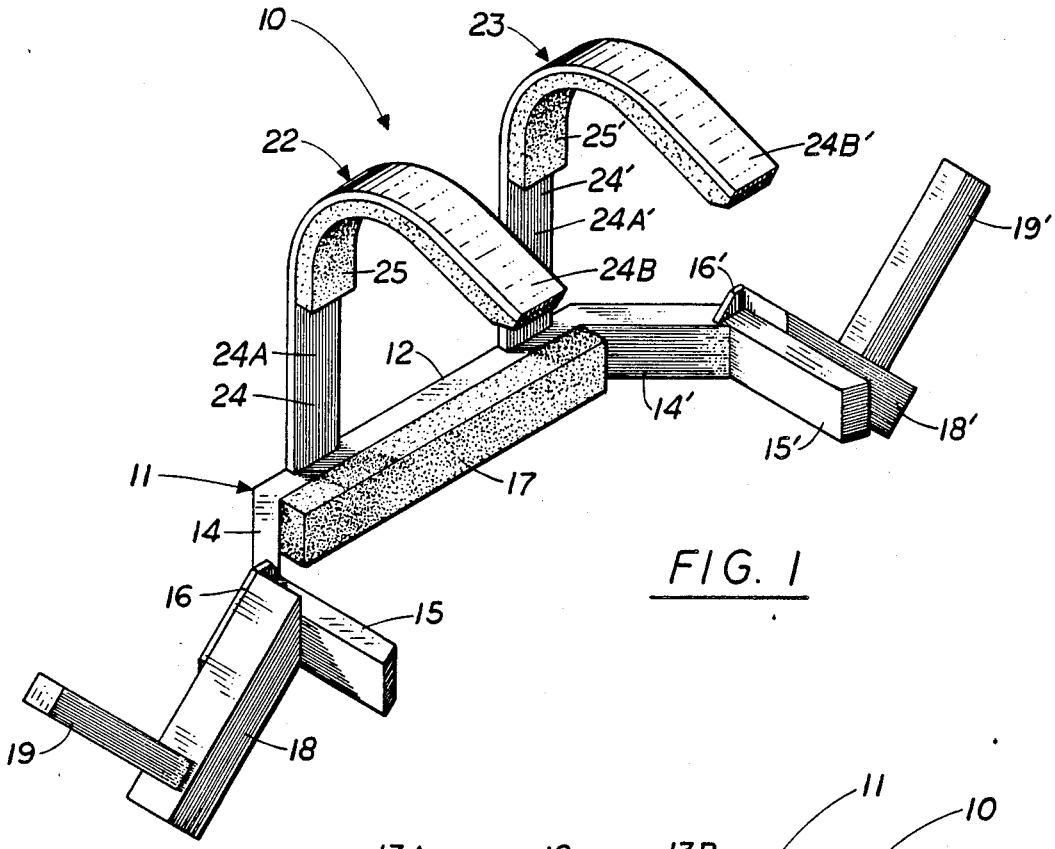
FIG. 1 is a rear perspective view of the weight trainer of this invention.

Referring first to FIG. 1, it is seen that the entire weight-training device 10 consists essentially of a plurality of frame members to form a main body 11. Attached to the main body 11 are a pair of spaced shoulder braces 22, 23.

Figure 2:
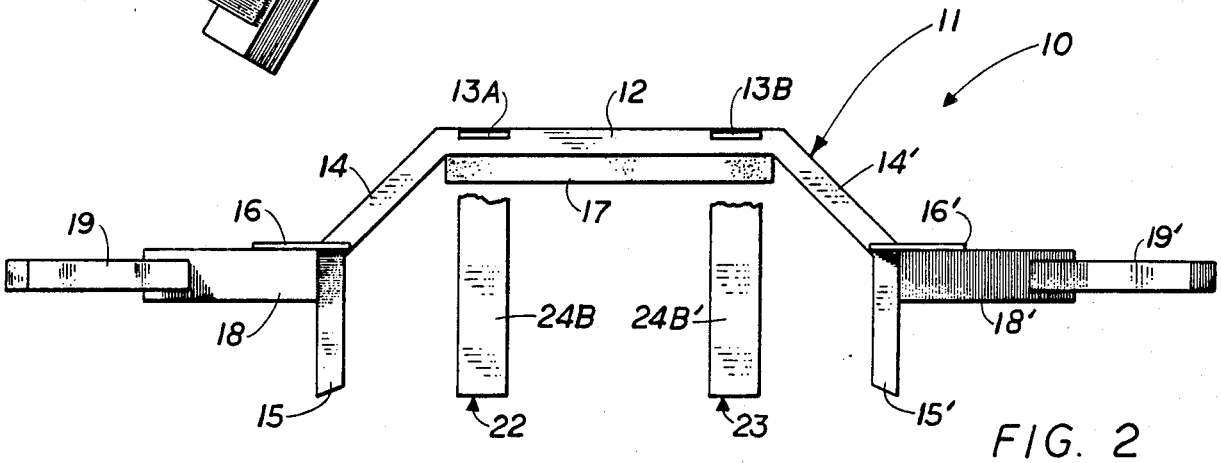
FIG. 2 is a top plan view of the main body of this device.
Figure 3:
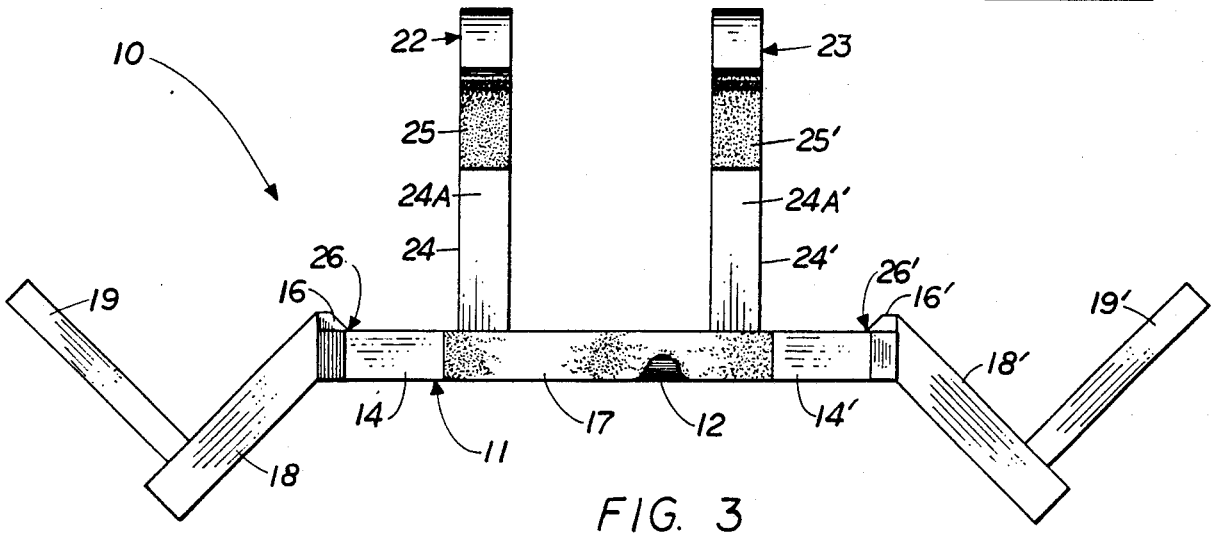
FIG. 3 is a rear elevational view of the device of this invention.

Reference should also be made to FIG. 2 wherein the various frame members forming the main body portion 11, are shown. Thus the main body 11 comprises a front bar 12 of metal such as steel or aluminum or durable plastic such as polycarbonate. All of the other frame members forming the main body are of like construction. As seen in FIG. 2, front bar 12 includes a pair spaced top elongated slots 13A and 13B. Attached at opposite ends of said bar 12 are a pair of first side bars 14, 14'. These side bars are disposed at preferably about a 45° angle. At the outer extremities of each of said first side bars, are second side bars 15, 15'. There are also disposed at preferably 45° angles with respect to the distal ends of the first side bars 14, 14'.

Figure 5:
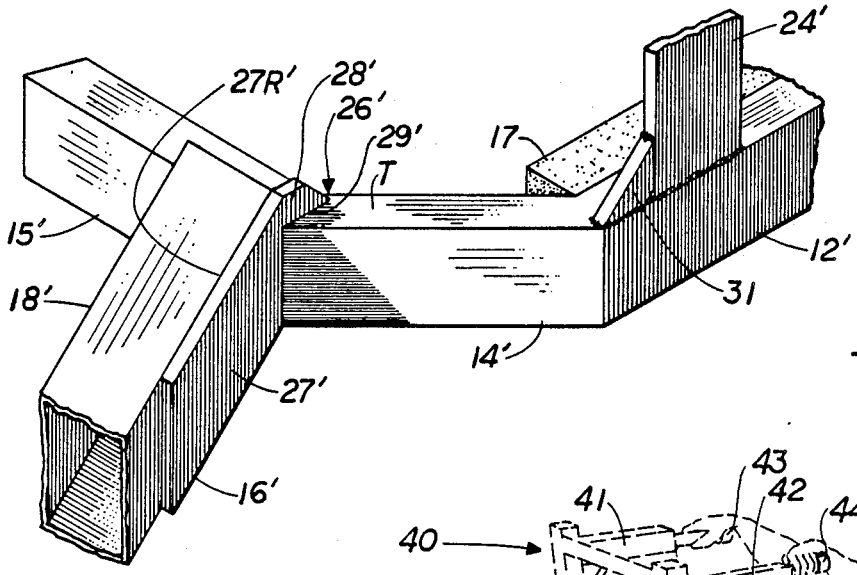
FIG. 5 is a close-up perspective view of an area of the device of this invention.

Upstanding flanges 16, 16, seen in FIG. 5 are disposed at the junction of the first and second side bars at locations 26, 26'. These flanges serve as weld points for angle members 18, 18'. Reference is made specifically to FIG. 5 wherein flanges 16, 16' are best seen. These flanges 16, 16' include a parallelogram shaped portion 27, 27' respectively and a generally triangular shaped gusset portion, 28, 28'. The base 29, 29' of each gusset is welded or otherwise secured along the top surface T of the junction location 26, 26' of the said first and second side members. The width of each gusset abuts the proximal angled side of the perspective portions 27, 27'. Rear faces 27R and 27R' of portions 27, 27' overlie and are welded or otherwise secured to angled members 18, 18' respectively. Flanges 16, 16' are preferably formed of about ¼ inch thick metal flat stock about 2 inches in width. The front bar 12, and first and second side bars 14 and 14' are preferably formed of rectangular tubing about 2" high by 1" deep. Typical lengths for the first and second side bars are 6–6½ inches and 6–6½ inches respectively.

Angled members 18, 18' are each about 10" long on the top surface 18T, 18T', and about 8" long on the under surface 18U, 18U'. These members 18, 18' are formed of 2" square tubing from which a triangular portion has been removed commencing at the upper proximal corner.

While flange members 16, 16' have been noted to include a parallelogram portion 27, 27', these portions can if desired be trapezoidal. There is no criticality to the angle of the distal side thereof. The proximal side must of course be at about 45° as this is the angle of disposition of the angled members 18, 18'.

Figure 4:
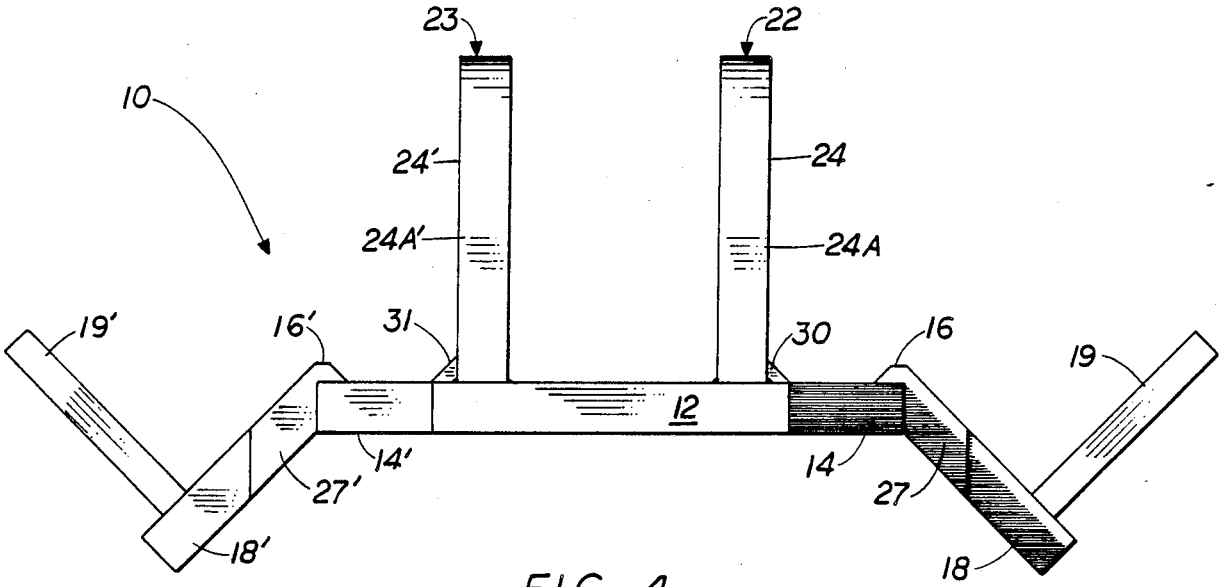
FIG. 4 is a front elevational view thereof.

Weight holders 19 and 19' which are formed preferably of 1–1¼ inch square tubing are disposed normal to said angled members 18. See FIG. 4. Preferably these are chrome plated both for aesthetics and because painted surfaces would tend to chip from the repetitive addition and removal of weights. The weight holders may be crimped or otherwise modified to have a slightly reduced diameter at the distal end to facilitate the placement of the weights thereupon.

The reader should return now to FIG. 2. Braces 22 and 23 are formed of a metal portion 24, 24' and rubber padded portion 25, 25'. The straight sections 24, 24A may be welded directly to the top surface of 12 flush with its front surface or alternately may be inserted into slots 13A and 13B and welded around the area where they emerge from the top of the 12. The arcuate portion 24B, 24B' are padded on their respective underside by the rubber pads 25, 25' which may be glued, or otherwise applied thereto. Foam urethane or natural foam rubber with some carbon black therein is recommended for durability. Preferably, a reinforcement gusset 30, 31 of a generally triangular shape is mounted, as by welding, one on each of the straight portions 24A, 24A' and their outer surface junctions with front bar 12, and to the front bar 12 to prevent flexing of braces 22, 23.

Front bar 12 is preferably padded in like manner with rubber pad 17.

Weights such as those of one pound or more are evenly applied on both sides of the weight holders 19, 19' when performing the various exercises.

Previously it has been indicated that the instant device represents a significant improvement over the trainer of Moore. At this point, the differences and advantages will be pointed out.

The Moore device had a 90° bend from its front bar to each side bar, which side bars basically paralleled the side of the body. It was found that such a girdle effect was not only uncomfortable both physically and mentally, since the distal ends of each side bar are connected to a rear bar to thereby box in the torso. In addition Moore's side bars interfered with arm movements.

By using two 45° bars, and not encircling the body, the device of this invention is quicker and easier to apply to the shoulders and avoids the closed or boxed-in feeling.

Whereas the weight holders of the prior art extend outwardly at 90° in opposite directions, the weight holders here are angled upwardly 45°. This feature not only provides easier weight loading, but also shifts the center of gravity more posteriorly, but also prevents the present device from swinging forward away from the stomach causing it to hit the tops of the frontal thighs when one assumes a low squat position.

Applicant's device also lends itself to be worn backward when the user wants to do leg lunges and regular squats.

Since applicant's device has no rear, it can be made to weigh less than the prior art unit, a benefit as far as reducing fatigue during periods of use.

In order to utilize the instant device, one picks up the device perhaps by the first side members, 14, 14' and places the shoulder braces 22, 23 on his own shoulders such that the shoulder pads 25, 25' rest thereupon. Weights may be applied by the user or a third party to the weight holders, 19, 19'.

Figure 6:
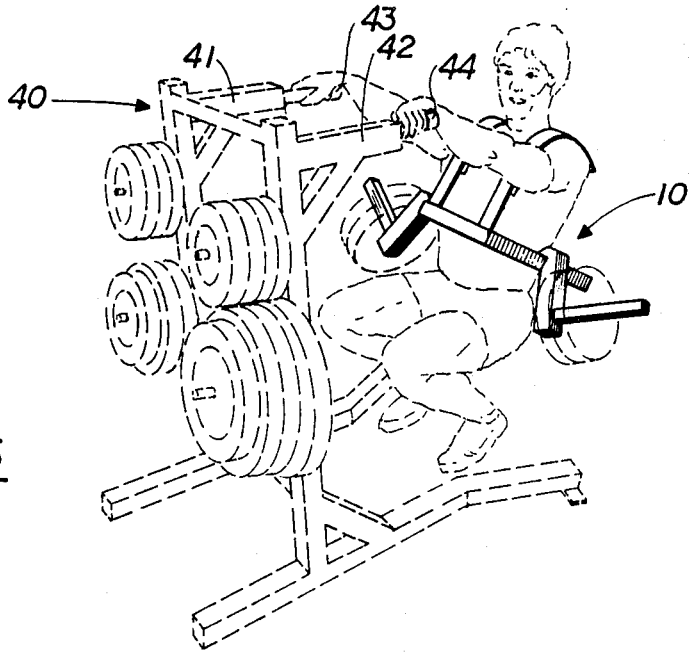
FIG. 6 is a perspective view showing the use of this device.

The device of this invention can be used by itself to do deep knee bends and other exercises as are well understood by those of skill in this art. However certain specialty exercises can be achieved with better balance if an exercise assist such the one designated 40 and shown in FIG. 6. Exercise assist 40 includes a pair of arm members 41, 42 each of which has a handle bar 43, 44 respectively. The user grabs a handle 43, 44 with each hand. He or she can then do balanced deep knee bends as shown in said figures.

While the weight holders as disclosed previously herein have been recited as being square in cross section, such as of square tubing, it is also contemplated herein that the diameter could be less than two inches for example one inch, and the cross sectional configuration can also be circular or even triangular if so desired.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A weight-training device to be placed on the shoulders of a weight lifter, which weight lifter has shoulders, arms a front, two sides, and a back, which device comprises:

a main body portion adapted to be positioned across the front of the body of a weight lifter and below the shoulders, which main body portion has a front bar and rearwardly and outwardly extending side members on opposite sides of said front bar and which portion is open at the back;

a pair of shoulder braces attached to said front bar at spaced locations and extending upwardly therefrom;

a pair of angled members rigidly attached to said main body, said angled members depending downwardly at about a 45 degree angle; and, weight holding means attached to said angled members.

2. In the weight-training device of claim 1 wherein the side members comprise first and second side members, and each of said first side members extends rearwardly and outwardly from opposite ends of said front bar.

3. In the weight-training device of claim 2 wherein the first side members depend at a 45° angle.

4. In the weight-training device of claim 2 wherein the first side members have a distal end and a proximal end, and the second side members extend rearwardly from the distal end of said first side members in the same horizontal plane as the front bar.

5. In the weight-training device of claim 4 wherein the second side members extend at a 45° angle relative to said first side members.

6. In the weight-training device of claim 5 wherein the angled members depend from the second side members and said angled members have weight holders upstanding thereon.

7. In the weight-training device of claim 6 wherein the angled members are mounted on the second side members at the junction of the first and second side members, and the weight holders are disposed normally upward from said angled members.

8. In the device of claim 7 further including reinforcing flanges depending outwardly at the junction of each of the first side members with its respective second side member.

9. In the weight-training device of claim 1 wherein the side members comprise first and second side members, each of which has a distal end and a proximal end, wherein the proximal end of each of said first side members is connected in the same horizontal plane to one end of said front bar and extends rearwardly therefrom at about a 45° angle; and each second side member's proximal end is connected to the distal end of its respective first side member and extends rearwardly therefrom at about a 45° angle in the same horizontal plane.

10. In the device of claim 9 wherein the shoulder braces and the front bar are padded on the side facing the weight lifter's body.

11. A weight-training device to be placed on the shoulders of a weight lifter, which weight lifter has shoulders, arms, a front, two sides, and a back, which device comprises:

a main body portion adapted to be positioned across the front of the body of weight lifter and below the shoulders, which main body portion has a front bar and rearwardly and outwardly extending side members on opposite sides of said front bar and which portion is open at the back;

a pair of shoulder braces attached to said front bar at spaced locations and extending upwardly therefrom;

a pair of angled members rigidly attached to said main body, said angled members depending downwardly at about a 45 degree angle; and, a pair of weight holders, one of which depends normally upwardly from each one of said side members.

12. In the device of claim 11 wherein the shoulder braces and the front bar are padded on the side facing the weight lifter's body.

13. In the device of claim 12 wherein the side members comprise first and second side members, and each of said first side members extends rearwardly and outwardly from opposite ends of said front bar at about a 45° angle in the same horizontal plane as said front bar.

14. In the device of claim 13 wherein the second side members extend rearwardly at a 45° angle relative to said first side members and further wherein the angled members depend downwardly from the second side members and said angled members have weight holders depending normally upward thereto.

15. In the device of claim 14 wherein the shoulder braces and the front bar are padded on the side facing the weight lifter's body, and at least the weight holders are chromium plated.

16. In the device of claim 15 wherein the balance of the device is painted metal.

17. In the device of claim 16 further including reinforcing flanges depending outwardly at the junction of each of the first side members with its respective second side member.

* * * * *